US007793453B1

(12) United States Patent
Sewell, Jr. et al.

(10) Patent No.: US 7,793,453 B1
(45) Date of Patent: Sep. 14, 2010

(54) RAPIDLY-ADJUSTABLE BUTT STOCK ASSEMBLY

(75) Inventors: Robert Wayne Sewell, Jr., Columbia, SC (US); Kevin M. Hass, Leesville, SC (US); Edward P. Schmitter, Eastover, SC (US); Eric S. Brisbon, Blythewood, SC (US)

(73) Assignees: FN Manufacturing, Columbia, SC (US); FN Herstal SA, Herstal (BE)

( * ) Notice: Subject to any disclaimer, the term of this patent is extended or adjusted under 35 U.S.C. 154(b) by 199 days.

(21) Appl. No.: 12/272,135

(22) Filed: Nov. 17, 2008

Related U.S. Application Data

(60) Provisional application No. 60/988,311, filed on Nov. 15, 2007.

(51) Int. Cl.
*F41C 23/14* (2006.01)

(52) U.S. Cl. ..... 42/73

(58) Field of Classification Search ..... 42/71.01, 42/71.02, 72, 73, 74, 75.03
See application file for complete search history.

(56) References Cited

U.S. PATENT DOCUMENTS 3,348,328 A * 10/1967 Roy ..... 42/73
5,173,564 A * 12/1992 Hammond, Jr. ..... 42/75.03
6,732,466 B2 * 5/2004 Bentley ..... 42/74
7,162,822 B1 * 1/2007 Heayn et al. ..... 42/73
2003/0140542 A1 * 7/2003 Kay ..... 42/75.03
2004/0016167 A1 * 1/2004 Fitzpatrick et al. ..... 42/71.01
2005/0108915 A1 * 5/2005 Kincel ..... 42/71.01
2006/0010749 A1 * 1/2006 Kincel ..... 42/71.01
2006/0254111 A1 * 11/2006 Giauque et al. ..... 42/72
2007/0199435 A1 * 8/2007 Hochstrate et al. ..... 89/191.02
2007/0261284 A1 * 11/2007 Keng ..... 42/73
2008/0028662 A1 * 2/2008 Abraham et al. ..... 42/73
2008/0110074 A1 * 5/2008 Bucholtz et al. ..... 42/1.06

* cited by examiner

*Primary Examiner*—Bret Hayes
(74) *Attorney, Agent, or Firm*—Michael A. Mann; Nexsen Pruet, LLC

(57) ABSTRACT

A rapidly-adjustable butt stock assembly comprised of a butt stock, a buffer, a slot cylinder, a key cylinder, and keys. The butt stock has a cylindrical recess with key grooves longitudinally therein for receiving the slot and key cylinders. The key cylinder is rigidly attached to the buffer. The slot cylinder has at least one longitudinal slot with a plurality of transverse slots extending therefrom. The key cylinder carries one or more keys, which keys extend through the key cylinder and the slot cylinder and into the key grooves of the butt stock. To adjust the length of the assembly, the user rotates the slot cylinder so that the keys rotate out of the transverse slots and into the longitudinal slot of the slot cylinder thus permitting the key cylinder to move axially with respect to the butt stock.

16 Claims, 7 Drawing Sheets

RAPIDLY-ADJUSTABLE BUTT STOCK ASSEMBLY

RELATED APPLICATIONS

The priority benefit of U.S. provisional patent application 60/988,311, filed Nov. 15, 2007, which is incorporated herein in its entirety by reference, is claimed.

BACKGROUND OF THE INVENTION

The present invention relates to fire arms in general and to the butt stocks of fire arms in particular.

The typical butt stock is a simple, rigid component extending from the receiver of the firearm rearward and engages the user's shoulder when the firearm is in the shoulder firing position. The distance between a firearm's trigger and the rear-most portion of the butt stock is known in the art as the pull length. The pull length for a firearm, such as a rifle, having a typical, rigid butt stock is fixed.

A rifle having an adjustable pull length is preferable to one having a fixed pull length for a number of reasons. For example, when a rifle is used by a subsequent, different user, the subsequent user needs to be able to adjust the pull length for comfort and shooting accuracy. In addition, even if the rifle is used by a single user, the manner in which the user is using the rifle (standing versus prone) and whether the rifle is equipped with optics (e.g., a scope) or other aiming devices (e.g., a bipod) will require that the pull length be adjustable for comfort and accuracy.

In addition to being adjustable, it is also important for a rifle butt stock to be simple and reliable, having a small number of parts, quickly and quietly adjustable, and very rugged. This is especially true for rifles used in combat. Rifles for combat that are used in the prone position need to be especially rugged due to the fact that they are often slammed to the ground when the user is transitioning from a standing to a prone position and may then be used as support when the user is transitioning from the prone to the standing position.

The top portion of the butt stock, upon which the user's cheek rests when firing, is known in the art as the comb. The height of the comb of a typical, rigid butt stock is fixed. Depending on the user and manner in which the rifle is being used, a comb of a fixed height may be uncomfortable for the user or impede accurate shooting if it prevents the user from properly viewing the reticle of a sighting device. It would be advantageous, therefore, to be able to adjust the height of the comb to maximize shooting accuracy and comfort.

Accordingly, there remains a need for simple, reliable, and rugged butt stock that provides for quick, quiet, and easy adjustment of pull length and comb height.

SUMMARY OF THE INVENTION

According to its major aspects and briefly recited, the present invention is a rapidly-adjustable butt stock assembly. The butt stock assembly is made of a rugged, rigid material such as metal, plastic, fiberglass, or carbon fiber. It includes a buffer assembly and a butt stock with a nested slot cylinder and key cylinder carried within the butt stock. The butt stock has a generally cylindrical recess formed in it with an axis aligned with the long dimension of the firearm. One or preferably two key grooves are formed in the wall of the cylindrical hole. The slot cylinder has a longitudinal slot and several spaced-apart transverse slots; the key cylinder carries one or more keys that extend radially from the key cylinder through the slots of the slot cylinder and into the key grooves in the cylindrical recess of the butt stock. Rotating the slot cylinder so that the keys are not in the transverse slots but in the longitudinal slot allows the key cylinder to be moved axially with respect to the slot cylinder in order to increase or decrease the length of the butt stock assembly.

On top of the butt stock is a saddle-shaped comb, which is also made of a rugged, rigid material. The front portion of the comb is pivotally attached to the butt stock so that the rear portion can be elevated above the butt stock by pivoting it with respect to the front portion. The opposing rear portion of the comb has two holes on each side that are dimensioned to receive a pair of spring-loaded buttons extending from the sides of the butt stock. The buttons can be pressed to free the comb from a first pair of comb holes. The comb can then be elevated until the next pair of comb holes comes into registration with the spring-loaded buttons. Releasing the buttons allows them to extend though these holes and thus secures the comb at the different elevation.

Residing within the cylindrical hole in the butt stock and extending from front to rear is a mechanism that allows the pull length of the firearm to be changed. This mechanism is comprised of a slot cylinder, a key cylinder within the slot cylinder, and keys carried by the key cylinder. The front end of the slot cylinder is open to receive the key cylinder; its back end is closed. The slot cylinder is free to rotate about its longitudinal axis within the cylindrical hole of the butt stock. The slot cylinder has at least one longitudinal slot and a plurality of spaced-apart transverse slots extending from the longitudinal slot so that the transverse slots communicate with each other and with the longitudinal slot. The slot cylinder remains almost entirely within the butt stock, but it has a collar at its front end that is exposed for use in rotating the slot cylinder. To rotate the slot cylinder, the user grips and rotates the collar, thereby rotating the slot cylinder within the butt stock.

Inside the slot cylinder and free to slide longitudinally therein is the key cylinder with two keys extending radially from the key cylinder. The length of each key is greater than the thickness of the slot cylinder's wall. Accordingly, the key of the key cylinder can extend through the slots of the slot cylinder and into the key groove of the cylindrical hole of the butt stock so as to prevent rotation of the key cylinder. However, the key cylinder can still move axially with respect to the butt stock. The key cylinder is attached to the receiver of the firearm through a buffer assembly.

When the key of the key cylinder extends through the transverse slots of the slot cylinder, butt stock assembly is in the "locked" position and the key cylinder cannot move axially with respect to the slot cylinder. But, when the key of the key cylinder extends through the longitudinal slot of the slot cylinder, the butt stock assembly is in the "unlocked" position and the key cylinder is then free to move axially with respect to the butt stock. A torsion spring within the butt stock urges the slot cylinder to rotate so that the key returns in the transverse slot, in the "locked" position, when the user is not manually rotating the collar.

To adjust the length of the butt stock assembly, the user, holding the rifle in one hand and the collar in the other, rotates the collar thereby rotating the slot cylinder against the urging of the torsion spring so that the key is moved out of the transverse slot and into the longitudinal slot. The key cylinder can then be moved axially with respect to the butt stock. By that axial movement, the user adjusts the pull length. When the user has adjusted the butt stock assembly to the desired pull length, the user then allows the torsion spring to rotate the slot cylinder back so that the key is recaptured within the transverse slots. The key cylinder is then, once again, in the "locked" position and can no longer be moved axially with respect to the butt stock. The user can then aim and fire the rifle in the same manner as before the pull length was adjusted.

These and other features and their advantages will be apparent to those skilled in the art of firearm technology from a careful reading of the Detailed Description of Preferred Embodiments accompanied by the following drawings.

DETAILED DESCRIPTION OF THE INVENTION

The present invention is a rapidly-adjustable butt stock assembly for use on a fire arm. For convenience, the muzzle end of the firearm is the fore end or front end and the cover plate end of the firearm is the back end or rear end. The firearm illustrated in FIG. 1, and generally indicated by reference number 10, has a major dimension, running from front to back, or muzzle end to cover plate end, which will define an axis. Unless otherwise defined herein, reference to axes is a reference to axes parallel to this major dimension. Rotations are with respect to this axis or an axis parallel to this one; axial movement means movement along this axis or an axis parallel to this one.

Figure 1:
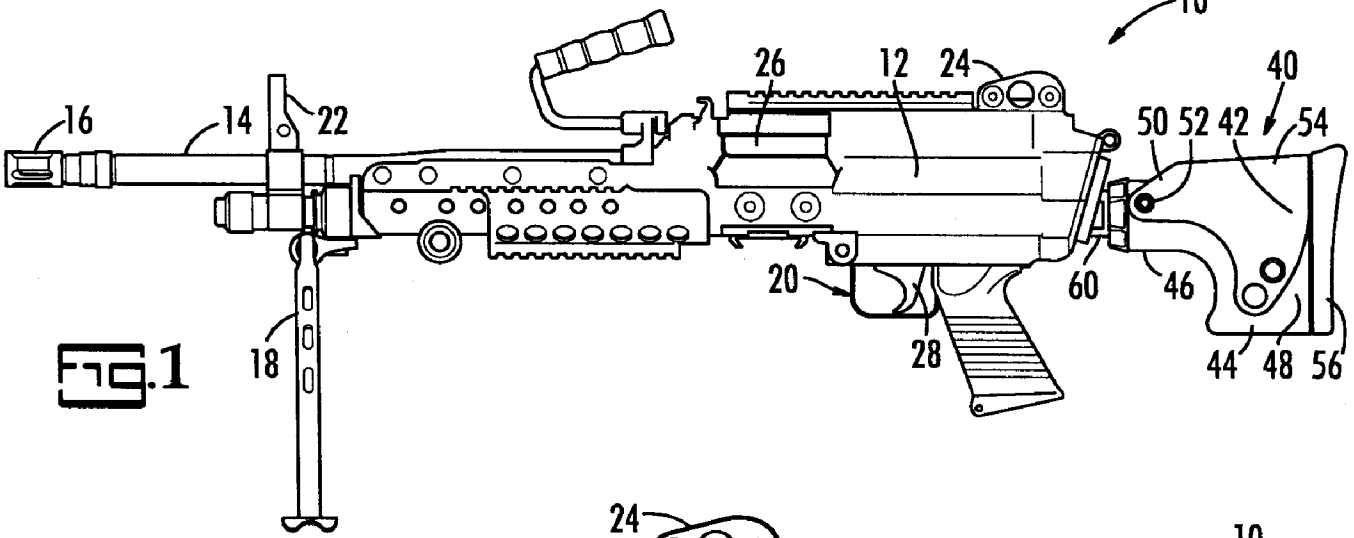
FIG. 1 is a side view of a firearm showing the adjustable butt stock assembly with its shortest pull length, according to a preferred embodiment of the present invention.
Figure 2:
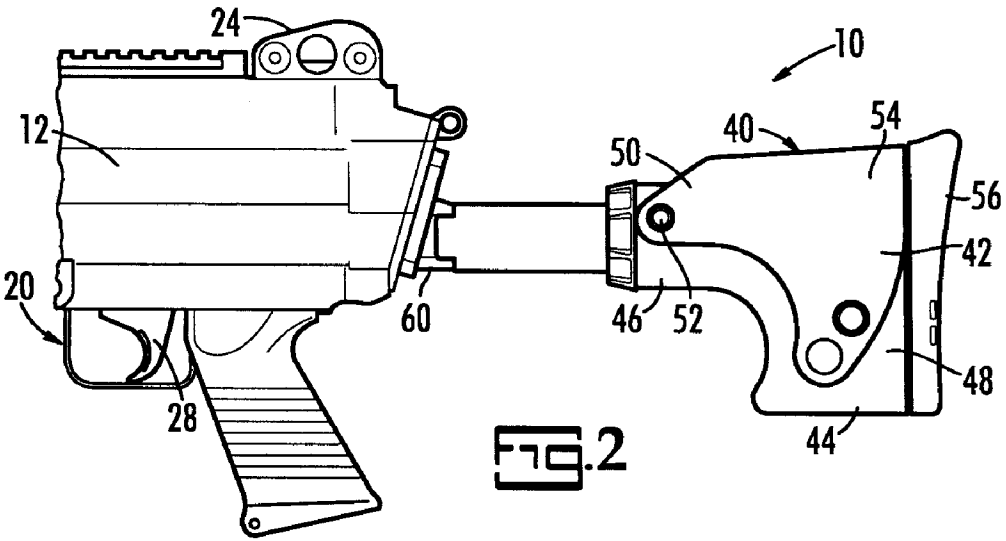
FIG. 2 is a partial side view of the firearm of FIG. 1 showing the adjustable butt stock assembly with its longest pull length, according to a preferred embodiment of the present invention.

Referring now to FIGS. 1 and 2, there is illustrated firearm 10 with a receiver 12, a barrel 14 on the end of receiver 12 and a muzzle 16 on the end of barrel. A bipod 18 may be used to support barrel 14. A trigger assembly 20 may be used to operate receiver 12. A front sight 22 cooperates with rear sight 24 to allow the user to aim firearm 10 so that when ammunition is fed into receiver 12 at opening 26 and a trigger 28 is pulled, the firearm will fire bullets (not shown) through barrel 14 and muzzle 16.

Rearward of receiver 12 is a butt stock assembly 40 according to a preferred embodiment of the present invention. Butt stock assembly 40 has a saddle-shaped comb 42 carried on a butt stock 44. Butt stock 44 has a front portion 46 and an opposing rear portion 48. Comb 42 has a front portion 50 that is carried by a pivot pin 52 proximate to front portion 46 of butt stock 44 so that a rear portion 54 of comb 42 can be raised to elevate its position when desired by the user, as will be described in more detail herein. Butt stock 44 carries a cover plate 56 on rear portion 48.

The pull length of firearm 10 is defined as the distance from trigger 28 to cover plate 56. FIG. 1 shows butt stock assembly 40 in a configuration wherein its pull length is shortest; FIG. 2 shows butt stock assembly 40 in a configuration wherein its pull length is longest. Butt stock assembly is joined to receiver using a buffer assembly 60.

Figure 3A:
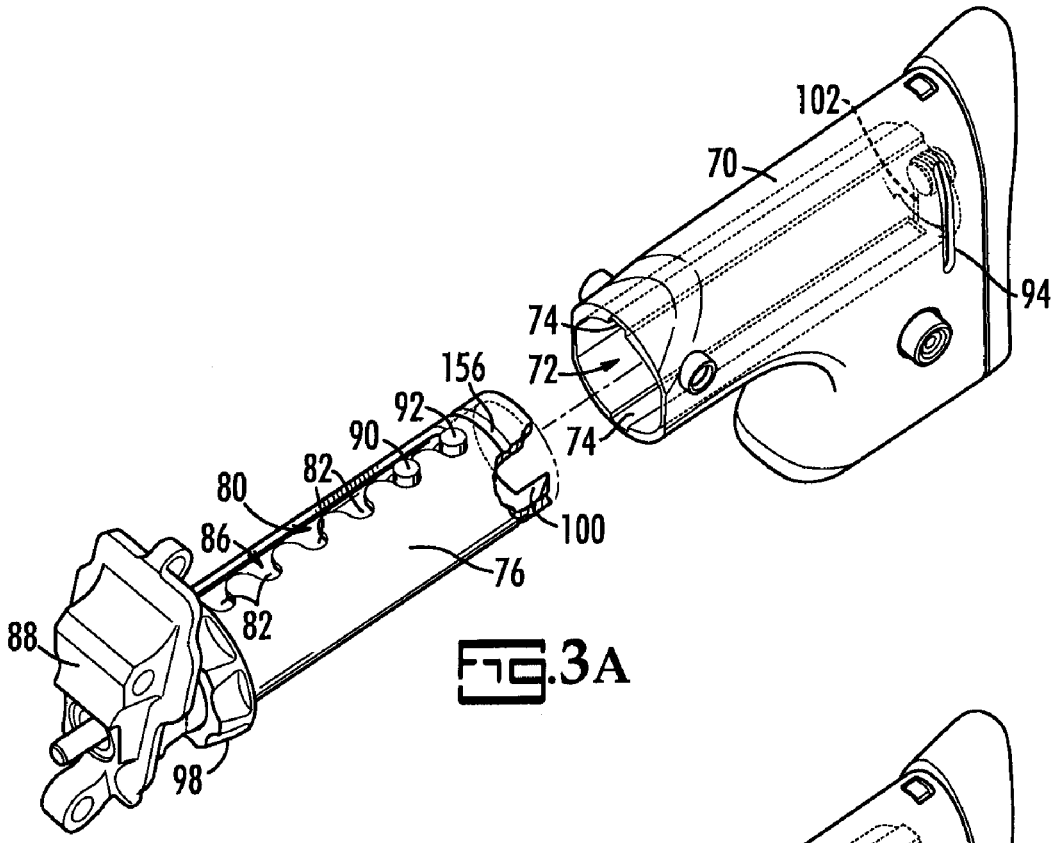
FIGS. 3A-3D are a series of perspective, exploded views of the butt stock, slot cylinder and key cylinder showing the transition from a locked butt stock assembly, an unlocked butt stock assembly, an axially adjusted pull length, and back to a locked butt stock assembly, according to a preferred embodiment of the present invention.
Figure 3B:
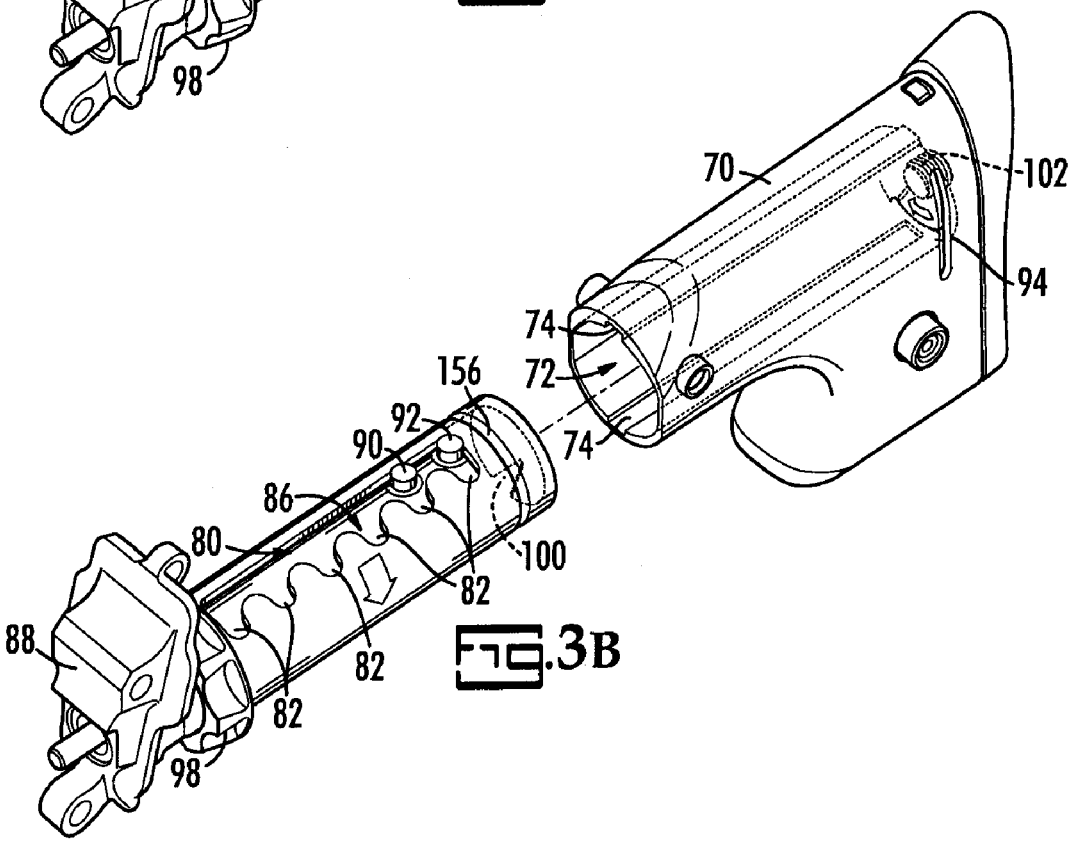
Figure 3C:
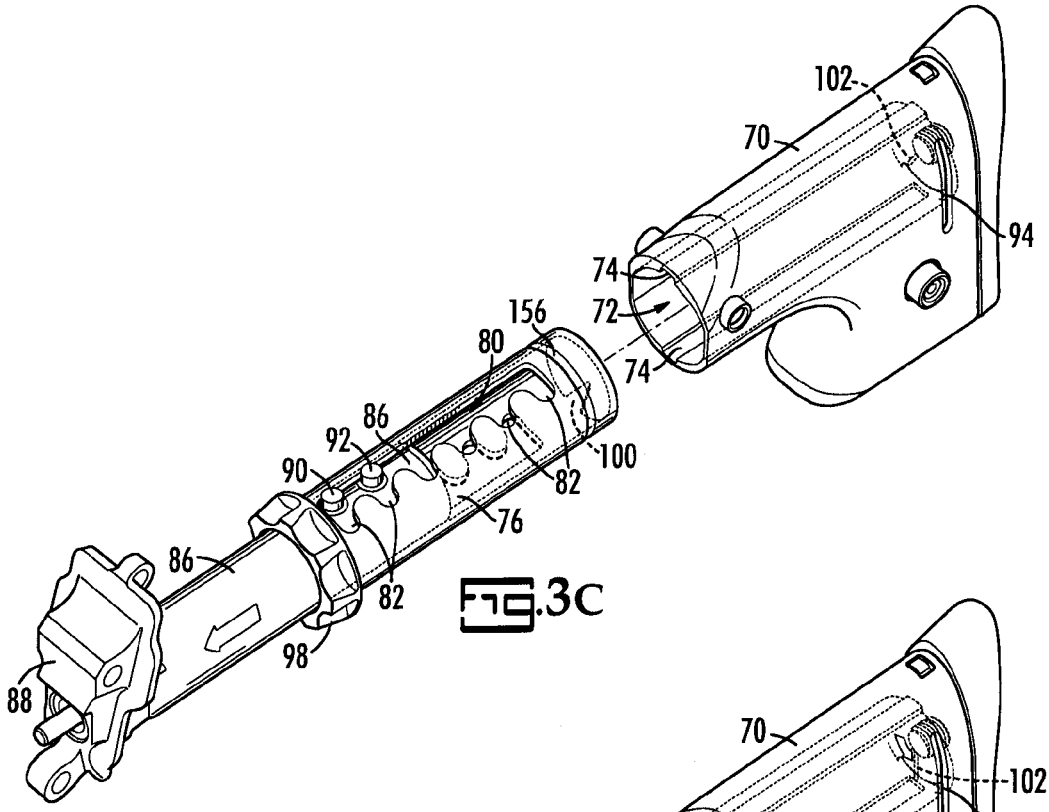
Figure 3D:
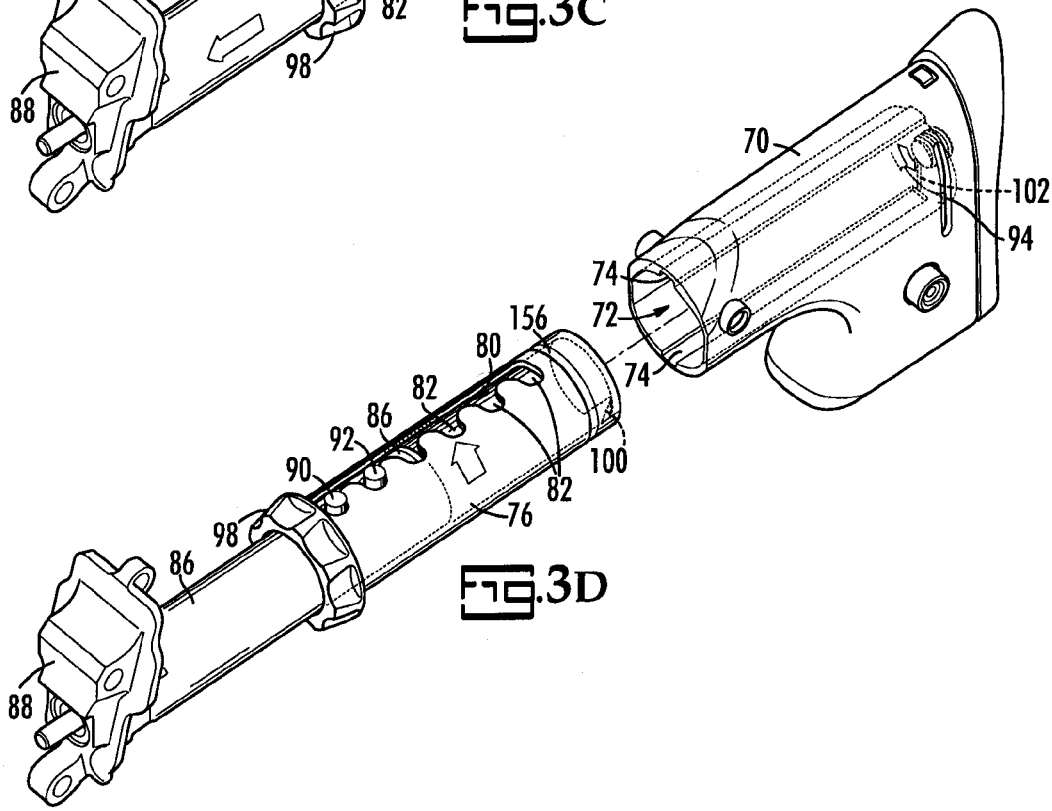

FIGS. 3A-3D are a series of views of several components of butt stock assembly 40 that permit the pull length of firearm 10 to be increased or decreased. In order that butt stock assembly 40 remains stable when its pull length has been set, it will lock into position automatically. To change its pull length, it must be unlocked. Accordingly, FIG. 3A illustrates the relevant components, in an exploded view, in an initial, locked configuration with a first pull length; FIG. 3B illustrates these components in the unlocked position but at the same pull length; FIG. 3C shows the same components with the pull length increased but still in the unlocked position; and finally, in FIG. 3D, in the longer pull length, but with the components again in the locked position.

Taking each of these four figures in order beginning with FIG. 3A, there is shown a butt stock 70 having a generally cylindrical recess 72 formed therein that is open toward the front. Formed toward the top and toward the bottom of cylindrical recess 72 are two, opposing key grooves 74. A nested pair of cylinders is shown that are normally inserted into cylindrical recess 72, but are shown in FIG. 3A removed for ease of understanding. The outer cylinder is a slot cylinder 76 with a longitudinal slot 80 and plural, spaced-apart transverse slots 82. Transverse slots 82 communicate with longitudinal slot 80. A second set of transverse and longitudinal slots is on the opposing side of slot cylinder and not visible in FIGS. 3A-3D.

Inside slot cylinder 76 is a key cylinder 86 carrying two keys 90, 92. Key cylinder 86 is attached to buffer assembly 88. Keys 90, 92 are fixed in key cylinder 86 and extend radially outward from key cylinder 86, on opposing sides, through the thickness of slot cylinder 76 and an additional distance sufficient to fit into key grooves 74 of butt stock 70. In order for key cylinder 86 and slot cylinder 76 to be inserted into butt stock 70, keys 90, 92, must be oriented so that they will fit into key grooves 74. Once key cylinder 86 is inserted into cylindrical recess 72, keys 90, 92 prevent key cylinder 86 from being rotated about its own axis; however, it can still be moved axially. Slot cylinder 76, however, once inserted into cylindrical recess 72 and held in an axial location by inserting a pin 150 (best seen in FIG. 6) through recess 94 and into a groove 156 located on the outside diameter of slot cylinder 76, will be prevented from axial movement but will still have radial movement when keys 90, 92 are in transverse slots 82. It is the limited radial movement of slot cylinder 76 and axial movement of key cylinder 86 that permit the locking, unlocking and extending of butt stock assembly 40.

In FIG. 3A, keys 90, 92, are in transverse slots 82 thus preventing axial movement of key cylinder 86. Under these circumstances, butt stock 70 is in a locked position, meaning that its pull length will not change. Rotation of slot cylinder 76 in the counter-clockwise direction (looking toward muzzle 16) as shown by the arrow in FIG. 3B by grasping a collar 98 on the forward end of slot cylinder 76 and rotating places keys 90, 92 in longitudinal slot 80, to permit the axial movement of key cylinder 86. As slot cylinder 76 is rotated, a cylinder tab 100 on its back end increasingly loads a torsion spring 102 (see arrow). Butt stock 70 is thus placed in an unlocked position in which its pull length can be changed as long as collar 98 is held against the urging of torsion spring 102. Comparing the axial position of key cylinder 86 with respect to slot cylinder 76 in FIGS. 3C to 3B shows that key cylinder 86 has moved axially with respect to slot cylinder 76 as indicated by the arrow in FIG. 3C.

Next, slot cylinder 76 is allowed to rotate clockwise when collar 98 is released, thus enabling cylinder tab 100 to reduce torsion spring 102 (see arrow). Slot cylinder 76 is rotated in the direction of the arrow in FIG. 3D to place keys 90, 92, in transverse slots 82 rather than longitudinal slot 80, placing it in a locked position held in position radially by the torsion spring 102, and thus preventing butt stock 70's axial movement once again. The force that rotates slot cylinder 76 is provided by the force of torsion spring 102 against slot cylinder tab 100 extending through slot 194 (see FIGS. 6 and 7).

Figure 4:
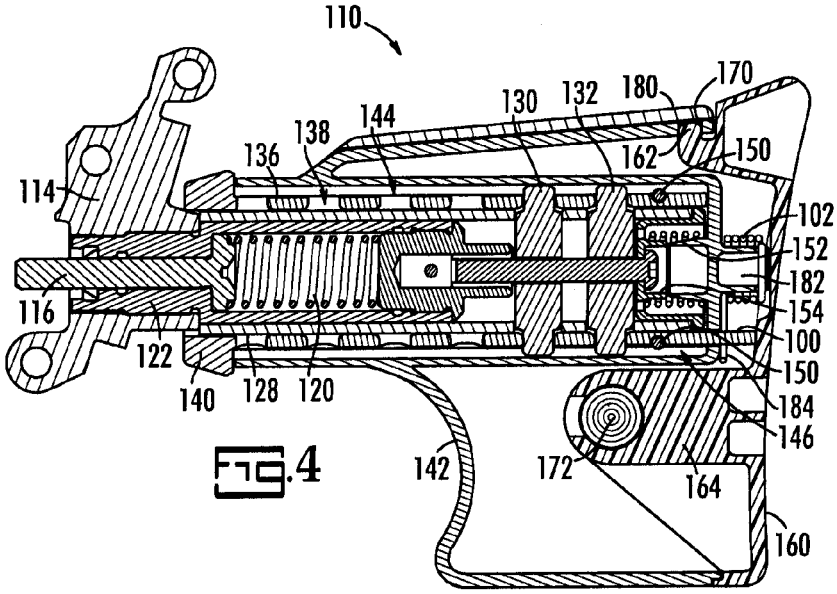
FIG. 4 is side cross-sectional view of the present butt stock assembly with pull length at its shortest, according to a preferred embodiment of the present invention.
Figure 5:
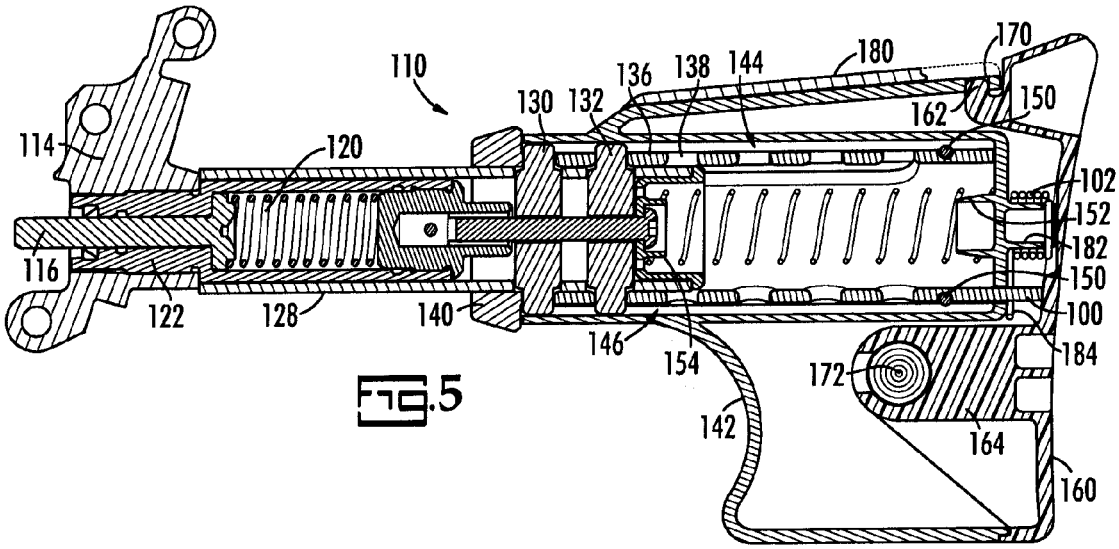
FIG. 5 is side cross-sectional view corresponding to that of FIG. 4 with pull length at its longest, according to a preferred embodiment of the present invention.

FIGS. 4 and 5 show side, cross-sectional views of butt stock assembly 110 in the minimum pull length and maximum pull length positions. It will be clear that intermediate positions are possible and, indeed, four positions are possible with the design shown. Assembly 110 includes a buffer assembly 112 running through much of assembly 110, beginning, from left to right, coupler 114, buffer piston 116 and buffer spring 120 all housed within buffer housing 122. Coupler 114 allows butt stock assembly to be coupled to the receiver of the firearm. Buffer piston 116 and buffer spring 120 take up the recoil of each round fired.

Buffer housing 122 is a cylinder that is fitted within key cylinder 128 which in turn carries two keys 130, 132. Keys 130, 132, may extend radially in both directions from key cylinder 128, through slots formed in a slot cylinder 136. In FIGS. 4 and 5 only transverse slots 138 are visible and there are six of them in this embodiment.

A collar 140 is integrally attached to the fore end of slot cylinder 136 to allow the user to rotate slot cylinder 136 with respect to key cylinder 128 from the locked position, as shown in FIGS. 4 and 5, to the unlocked position wherein a longitudinal slot (see FIGS. 3A-3D) is aligned with keys 130, 132.

Figure 6:
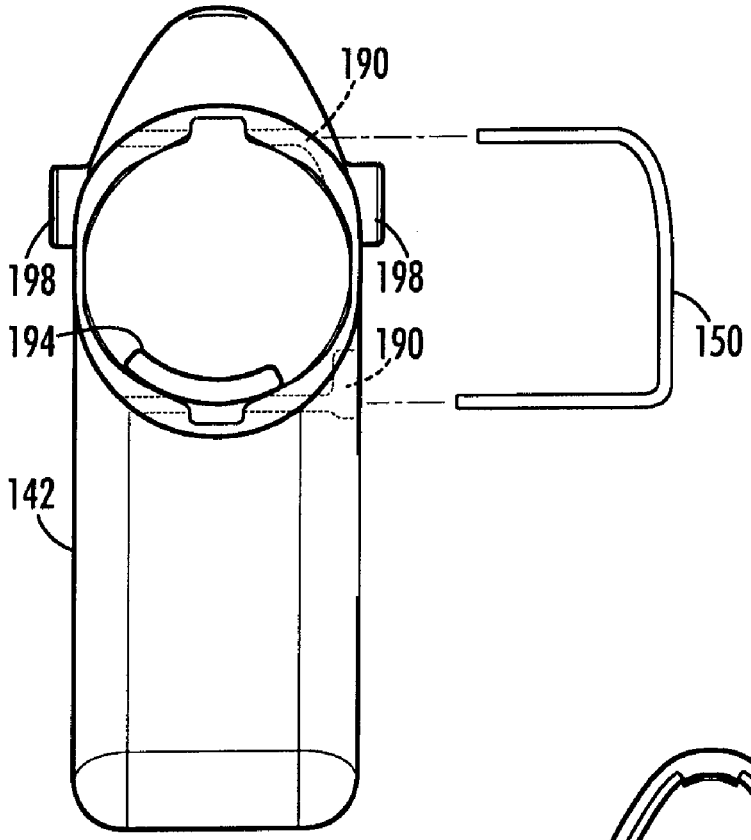
FIG. 6 is an exploded front end view of the butt stock, according to a preferred embodiment of the present invention.

Slot and key cylinders 136, 128, fit within cylindrical recess of butt stock 142, with keys 130, 132, extending into key grooves 144, 146, respectively, to prevent rotation of key cylinder 128. A U-shaped pin 150, best seen in FIG. 6, is inserted into U-shaped hole 190 formed in the side of butt stock 142 and thence into an annular groove 156 formed in slot cylinder 136, with the ends of pin 150 being transverse to slot cylinder 136, as best seen in FIGS. 3A-3D. Groove 156 is formed in the back end of slot cylinder 136 to receive pin 150 which thus prevents slot cylinder 136 from moving axially when key cylinder 128 is moved axially. Butt stock 142 has a compression spring 148 to urge key cylinder 128 forward when keys 130, 132, are in the longitudinal slot of slot cylinder 136. One end of compression spring is seated on a bushing 152 at the back end of butt stock 142 and the opposing end of compression spring 148 is seated on a similar bushing 154 on the back end of key cylinder 128. Compression spring 148 is compressed when key cylinder 128 is moved to the shortest pull length, as shown in FIG. 4, and is relieved when moved to its longest pull length, as shown in FIG. 5.

Figure 9:
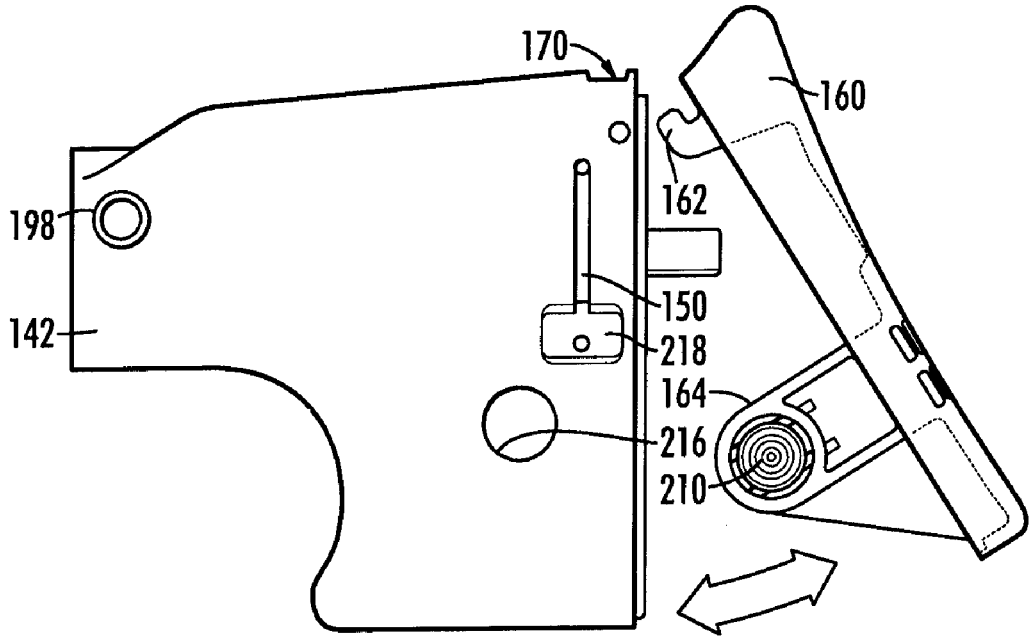
FIG. 9 is a side view of the butt stock with cover plate shown being removed from the butt stock, according to a preferred embodiment of the present invention.
Figure 10:
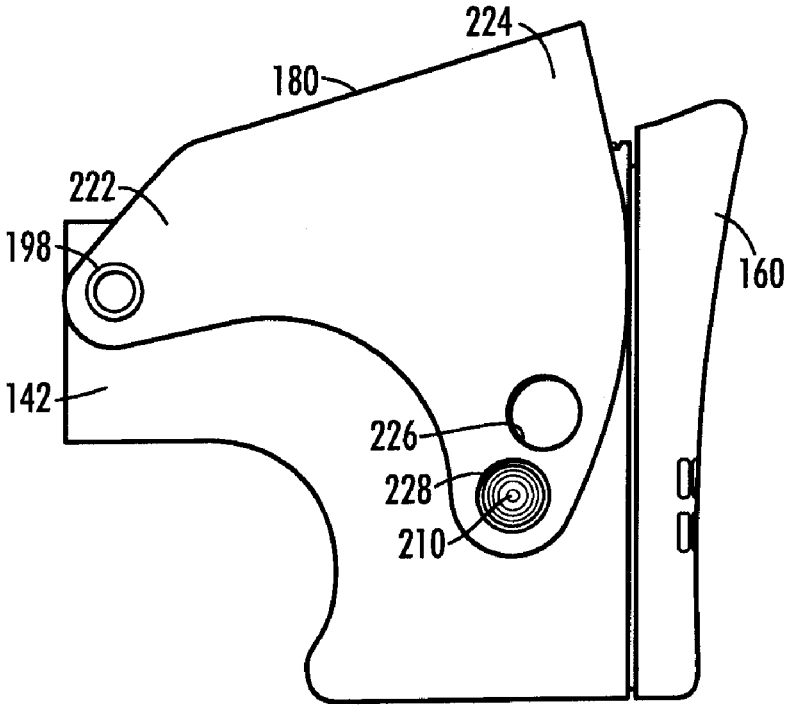
FIG. 10 is a side view of the butt stock showing the comb elevated to a higher position, according to a preferred embodiment of the present invention.

Butt stock 142 includes a cover plate 160 having a hook 162 at the top and a spring-loaded button mechanism 164 at the bottom to secure cover plate 160 to butt stock 142. Hook 162 is inserted into a cutout 170 at the top of butt stock 142 and opposing spring-loaded buttons 172 of spring-loaded button mechanism extend through opposing holes formed in the sides of butt stock 142 (as best seen in FIGS. 9-10) to secure cover plate 160 to butt stock 142. A saddle-shaped comb 180 is carried on top butt stock 142.

A torsion spring 180 is carried on a bushing 182 at the rearmost portion of butt stock 142 to urge slot cylinder 136 to rotate to the locked position. The end 184 of torsion spring 102 extends downward and catches cylinder tab 100 so that when slot cylinder 136 is rotated, cylinder tab 100 tightens torsion spring 102. When collar 140 is used to rotate slot cylinder 136 counter-clockwise, slot cylinder 136 is moved against the urging of torsion spring 102. Releasing collar 140 causes torsion spring 102 to rotate cylinder tab 100 and, with it, slot cylinder 136 counter-clockwise to the locked position.

FIG. 6 illustrates an exploded, front view of butt stock 142 with U-shaped pin 150 to the left. Pin 150 fits into a U-shaped hole 190 and into an annular groove 156 on slot cylinder 136 (see FIGS. 3A-3D for annular groove 156) to capture slot cylinder 136 and thereby prevent its axial movement when key cylinder 128 is moved axially. A crescent-shaped hole 194 in the back of butt stock 142 permits cylinder tab 100 of slot cylinder 136 to extend rearward beyond the back of butt stock to capture end 184 of torsion spring 102 and, load torsion spring 102 when slot cylinder 136 is rotated counter-clockwise. Finally, at the top of butt stock 142 are two pivot pins 198 about which the front portion of comb will pivot.

Figure 7:
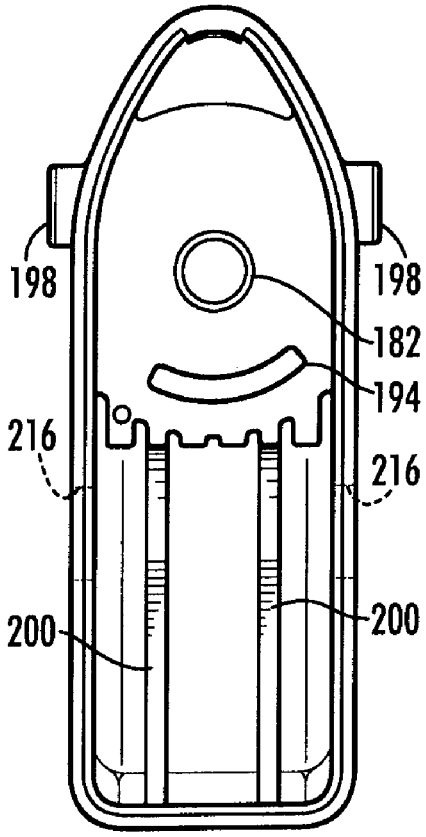
FIG. 7 is a rear view of the butt stock without a cover plate, according to a preferred embodiment of the present invention.

FIG. 7 illustrates the back view of butt stock 142. Visible in FIG. 7 is a bushing 182 for torsion spring 102 and crescent-shaped hole 194 for the tooth-shaped end portion of slot cylinder 136 and pivot pins 198 for the comb. Below, two ribs 200 help to reinforce butt stock 142 and align spring-loaded button mechanism 164 of cover plate 160.

Figure 8:
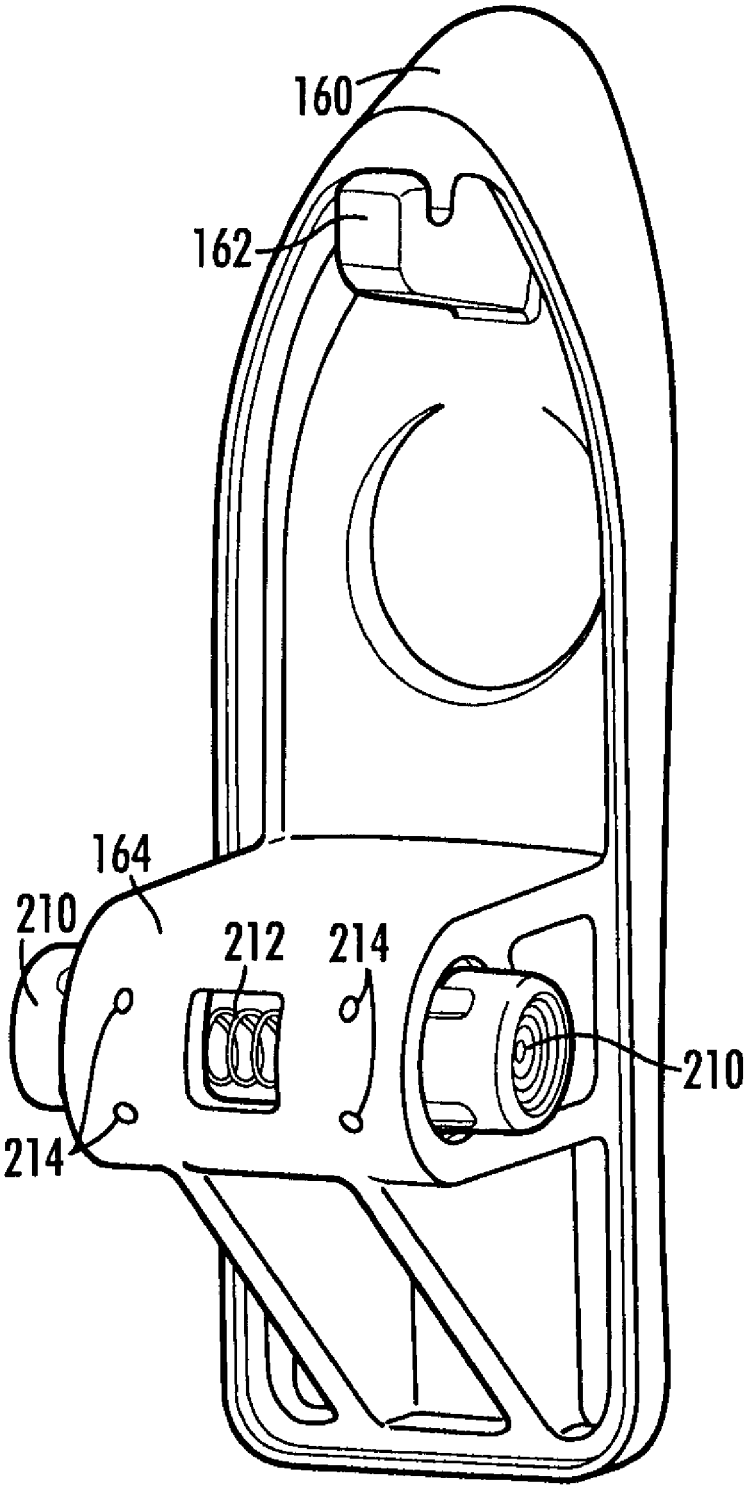
FIG. 8 is a perspective view of the cover plate showing the spring-loaded button mechanism, according to a preferred embodiment of the present invention.

FIG. 8 is a perspective view of cover plate 160 showing spring-loaded button mechanism 164 and hook 162. Button mechanism 164 includes two spring-loaded buttons 210. with a spring 212 urging them laterally in opposing directions. Small transverse pins 214 hold buttons 210 to cover plate 160.

FIG. 9 shows a side view of butt stock 142 with cover plate 160 shown rotated away from butt stock 142, as indicated by the arrow. Cutout 170, shown at the top rear of butt stock 142, is dimensioned to receive hook 162 and thereby hold the top of cover plate 160 to butt stock 142. Spring-loaded button mechanism 164, when buttons 210 are both pressed, will slide into the lower portion of butt stock 142 and, when fully seated, buttons 210 will extend through holes 216 of butt stock 142 to hold the lower portion of cover plate 160 to butt stock 142. Also visible in FIG. 9 is pivot pin 198 for the comb and U-shaped pin 150 in U-shaped hole 190. Hole 190 has an enlarged portion 218 to facilitate removal of pin 150 and release of slot cylinder 136 for cleaning the interior of butt stock 142.

FIG. 10 illustrates butt stock 142 with comb 180 in an elevated position compared to that shown in FIG. 2. The front portion 222 of comb 180 pivots about pivot pin 198 to allow rear portion 224 to be raised or lowered to different elevations. Holes 226, 228 allow two different elevations of comb 180 to be secured when button 210 extends through hole 226 or 228 depending on the elevation of rear portion 224 of comb 180. Partially pressing button 210, allows the elevation of rear portion 224 of comb 180 to be changed; completely pressing button 210, allows cover plate 160 to be removed from butt stock 142. Thus, spring-loaded button mechanism serves two purposes: allowing height adjustment of the rear portion 224 of comb 180 and securing or releasing cover plate 160.

It is intended that the scope of the present invention include all modifications that incorporate its principal design features, and that the scope and limitations of the present invention are to be determined by the scope of the appended claims and their equivalents. It also should be understood, therefore, that the inventive concepts herein described are interchangeable and/or they can be used together in still other permutations of the present invention, and that other modifications and substitutions will be apparent to those skilled in the art from the foregoing description of the preferred embodiments without departing from the spirit or scope of the present invention.

What is claimed is:

1. A butt stock assembly, comprising:

a butt stock having a generally cylindrical recess formed therein;

a buffer assembly, said butt stock being carried by said buffer assembly; and a comb having a front portion and an opposing rear portion, said comb being carried by said butt stock so that said comb pivots from a point proximate said front portion so that said rear portion is elevatable with respect to said butt stock, wherein said butt stock has a hollow slot cylinder carried within said cylindrical recess and connected to said buffer assembly, said slot cylinder having spaced-apart transverse slots and a longitudinal slot, said transverse slots communicating with said longitudinal slot, a key cylinder carried within said hollow slot cylinder, and a key carried by said key cylinder so that said key extends radially outward from said key cylinder into either one of said transverse slots or said longitudinal slot whereby said key cylinder can be moved axially with respect to said slot cylinder by rotating said slot cylinder so that said key carried by said key cylinder is in said longitudinal slot.

2. The butt stock assembly as recited in claim 1, further comprising a torsion spring in operative connection with said key cylinder and said butt stock to urge said key of said key cylinder into one of said transverse slots of said slot cylinder.

3. The butt stock assembly as recited in claim 1, wherein said cylindrical recess formed in said butt stock has a key groove and wherein said key carried by said key cylinder extends through either one of said transverse slots or said longitudinal slot of said slot cylinder into said key groove, said key groove preventing rotation of said key cylinder with respect to said butt stock but not with respect to said slot cylinder.

4. The butt stock assembly as recited in claim 1, further comprising a spring-loaded button carried by said butt stock and wherein said comb has plural holes formed in said rear portion, said holes being dimensioned to fit into said plural holes, each hole of said plural holes holding said comb at a different elevation.

5. The butt stock assembly as recited in claim 1, wherein said slot cylinder carries a collar, said collar permitting rotation of said slot cylinder with respect to said key cylinder.

6. The butt stock assembly as recited in claim 1, wherein said butt stock further comprises:

an end cap; and a shoulder rest pivotally attached to said end cap so that said shoulder rest can be pivoted from a first position parallel to and against said end cap and a second position perpendicular to said end cap.

7. The butt stock assembly as recited in claim 1, wherein said butt stock has a button hole formed therein and further comprising:

an end cap carried by said butt stock; and a spring-loaded button mechanism with a spring loaded button dimensioned to fit into said button hole, said end cap carrying said spring-loaded button mechanism, said spring-loaded button extending through said button hole to secure said end cap to said butt stock.

8. A butt stock assembly, comprising:

a butt stock having a generally cylindrical hole formed therein, said cylindrical hole having a key groove formed therein;

a hollow slot cylinder carried within said cylindrical hole of said butt stock and having plural spaced-apart transverse slots and a longitudinal slot, said transverse slots communicating with said longitudinal slot, said longitudinal slot being aligned with said key groove of said butt stock;

a key cylinder carried within said hollow slot cylinder;

a buffer assembly carried by said key cylinder; and a key carried by said key cylinder and extending through either one of said transverse slots or said longitudinal slot so that said key extends radially outward from said key cylinder through either one of said transverse slots or said longitudinal slot of said slot cylinder into said slot groove of said cylindrical hole in said butt stock, whereby said key cylinder can be moved axially with respect to said slot cylinder when said key of said key cylinder is in said longitudinal slot but is prevented from moving axially when said key of said key cylinder is in a transverse slot of said plural transverse slots.

9. The butt stock assembly as recited in claim 8, further comprising a second key and wherein said plural transverse slots is at least three slots.

10. The butt stock assembly as recited in claim 8, wherein said slot cylinder carries a collar, said collar permitting rotation of said slot cylinder with respect to said key cylinder.

11. The butt stock assembly as recited in claim 8, further comprising a torsion spring in operative connection with said key cylinder and said butt stock to urge said key of said key cylinder into one of said transverse slots of said slot cylinder.

12. The butt stock assembly as recited in claim 8, wherein said butt stock further comprises:

an end cap; and a shoulder rest pivotally attached to said end cap so that said shoulder rest can be pivoted from a first position parallel to and against said end cap and a second position perpendicular to said end cap.

13. The butt stock assembly as recited in claim 8, wherein said butt stock has a button hole formed therein and further comprising:

an end cap carried by said butt stock; and a spring-loaded button mechanism with a spring loaded button dimensioned to fit into said button hole, said end cap carrying said spring-loaded button mechanism, said spring-loaded button extending through said button hole to secure said end cap to said butt stock.

14. The butt stock assembly as recited in claim 8, further comprising a pivotable comb.

15. The butt stock assembly as cited in claim 14, wherein said comb has a front portion and an opposing back portion and wherein said front portion of said comb is pivotally attached to said butt stock so that said back portion can be elevated above said butt stock.

16. The butt stock assembly as recited in claim 15, wherein said butt stock includes a spring-loaded button assembly with a spring-loaded button, wherein said butt comb has at least two button holes formed therein dimensioned for receiving said spring-loaded button, each button hole of said at least two button holes holding said comb at a different elevation with respect to said butt stock.

* * * * *